United States Patent [19]

Bedell et al.

[11] Patent Number: 4,589,470

[45] Date of Patent: May 20, 1986

[54] METHOD AND APPARATUS FOR COOLING A MOVING CHILL SUBSTRATE

[75] Inventors: John R. Bedell; Paul G. Friedmann, both of Madison, N.J.; Julian H. Kushnick; Eli Rosenthal, both of Brooklyn, N.Y.; James R. Hubbard, Budd Lake; Christian J. Zingler, Succasunna, both of N.J.

[73] Assignee: Electric Power Research Institute Inc., Palo Alto, Calif.

[21] Appl. No.: 608,079

[22] Filed: May 8, 1984

Related U.S. Application Data

[63] Continuation of Ser. No. 327,675, Dec. 4, 1981, abandoned.

[51] Int. Cl.[4] ..... B22D 11/06; B22D 11/124

[52] U.S. Cl. ..... 164/463; 164/423; 164/429; 164/443; 164/474; 164/479; 164/485

[58] Field of Search ..... 164/485, 481, 431, 432, 164/443, 463, 474, 479, 423, 429

[56] References Cited

U.S. PATENT DOCUMENTS 3,310,849 3/1967 Hazelett et al. ..... 164/432

3,502,135 3/1970 Wertli ..... 164/253

FOREIGN PATENT DOCUMENTS 494191 9/1976 Australia ..... 164/432

7801735 9/1978 Belgium ..... 164/431

456056 7/1968 Switzerland .

*Primary Examiner*—Nicholas P. Godici

*Assistant Examiner*—J. Reed Batten, Jr.

*Attorney, Agent, or Firm*—King and Schickli

[57] ABSTRACT

A cooling apparatus and related method for a continuous casting apparatus includes a series of spray nozzles for spraying a coolant against one surface of a moving chill substrate. The invention apparatus includes an enclosure having vacuum applied thereto for preventing migration of the sprayed coolant from the surface against which it is sprayed to the surface contacting the molten solidifying material. Any coolant having a tendency to escape along sealed edges of the enclosure is forced back into the enclosure by the pressure gradient. The edges are sealed by elongated plastic rods. Additionally, scrapers are provided for removing remanent coolant from the sprayed surface. The coolant is sprayed at a high velocity to increase its heat transferring efficiency.

24 Claims, 8 Drawing Figures

Fig. 5
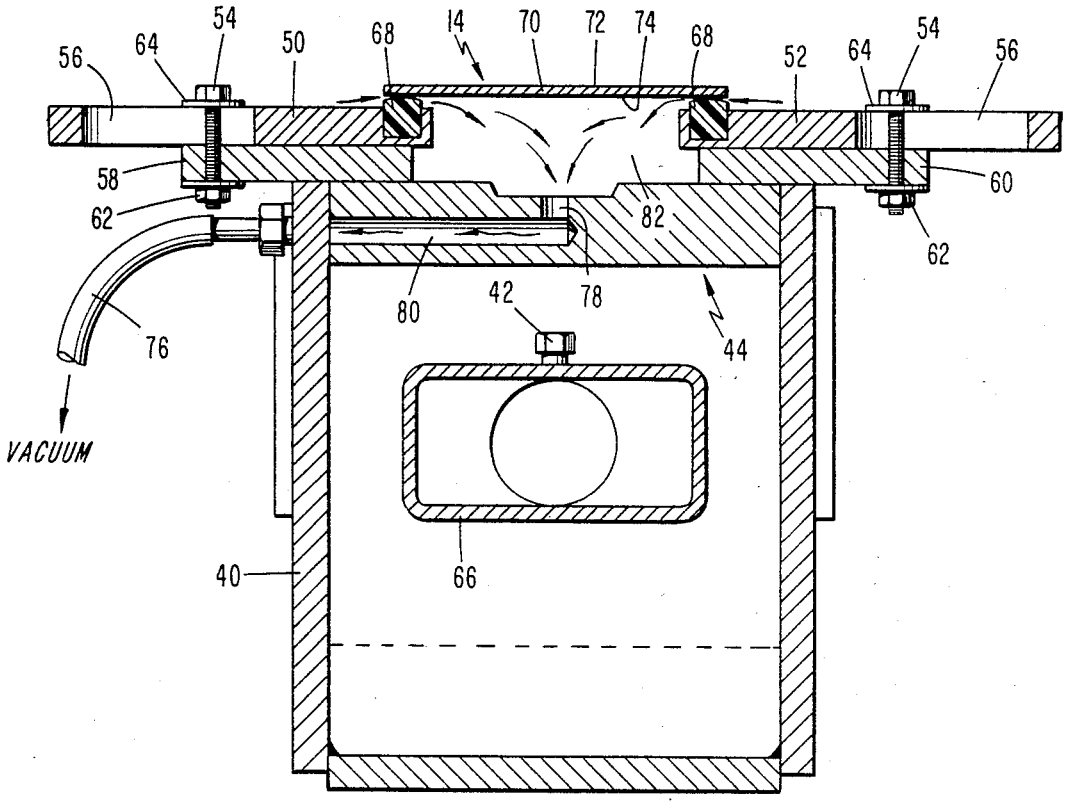
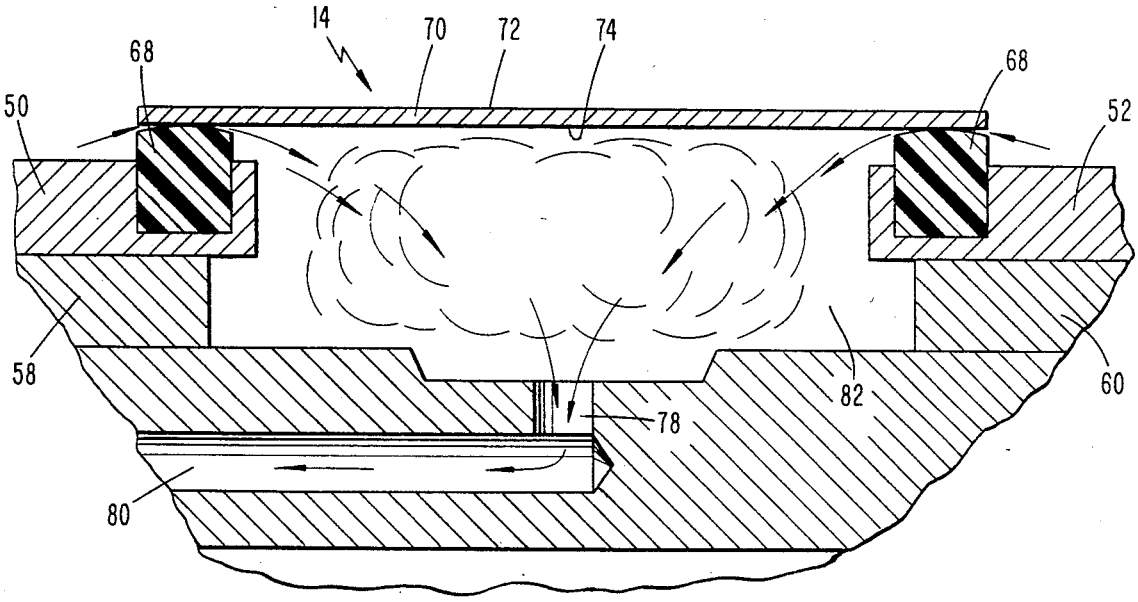
Fig. 6

METHOD AND APPARATUS FOR COOLING A MOVING CHILL SUBSTRATE

This is a continuation of application Ser. No. 327,675, filed Dec. 4, 1981, and now abandoned.

TECHNICAL FIELD

This invention relates to cooling of moving chill surfaces used in continuous casting processes. More particularly, the invention relates to such cooling in which a first surface of a substrate receives molten solidifying material for rapid quenching and a coolant is sprayed onto a second surface of the substrate and prevented from contacting the first mentioned surface.

BACKGROUND ART

In the metal casting art, a continuous casting process is known in which a molten metal is ejected from a crucible through a nozzle onto a surface of a moving chill body, as described in U.S. Pat. No. 4,142,571 to Narasimhan.

The casting apparatus, which may be used for casting metal filaments, such as strips, sheets, ribbons or even round or square wire of amorphous metal alloys, includes either a moving chill belt or an annular chill roll as the moving chill body or substrate.

In the prior art, it is recognized that the moving chill substrate may be cooled on the surface opposite to the surface upon which the molten material is received. Thus, in U.S. Pat. No. 2,383,310 to Hazelett, for example, a melt is deposited on the outer surface of the main cooling ring 5, and pressurized water is discharged through a number of nozzles 38-1 against the inner surface of the ring for cooling the ring.

While Hazelett recognizes the need to avoid contact between the metal and cooling water, the only precaution taken is the provision of a chamfer in a roll in which the cooling ring travels, as well as the provision of a surfacing ring which is wider than the roll thereby to permit water runoff without contact with the molten metal. Such an approach, however, does not provide an efficient means for positive prevention of water coolant from reaching the outer surface of the ring. Thus, the detrimental effects of a contact between the coolant and the metal may be experienced in the Hazelett structure due to seepage of the coolant towards the outer ring surface.

U.S. Pat. No. 3,976,117 to Olsson shows, at FIG. 14 thereof, a sprayer for a coolant directed at the underside of a travelling belt used in a casting apparatus. The upper surface of the belt provides the chill surface for the solidifying molten metal. No provision is made, however, for assuring that none of the coolant seeps to the upper surface, where it may adversely affect the strand of metal being cast. The only disclosure of removal of a liquid from the belt is related to removal of a cleaning liquid, where a rubber squeegee 134 is used to remove the cleaning liquid from the same surface of the belt which receives the solidifying metal.

The prior art thus fails to provide adequate measures for assuring that moisture or other contaminants found in the coolant do not travel to and contact the chill surface of a moving substrate. Such failure may lead to contaminated, poor quality cast ribbon or filament.

DISCLOSURE OF THE INVENTION

It is accordingly an object of the present invention to overcome the deficiencies of the prior art, and to provide a method and apparatus for producing high quality cast filaments by reducing contamination of the filaments by a coolant used for cooling a moving chill surface in a continuous casting operation.

It is a more specific object of the invention to reduce migration of a coolant sprayed against one surface of a moving substrate from that surface to the opposite surface where it may detrimentally contact solidifying material cast thereon.

It is yet another object of the present invention to provide a pressure differential between the two surfaces of a moving chill substrate, thereby to prevent migration of liquid coolant sprayed against one of the surfaces from that surface to the other.

It is still a further object of the invention to provide scraping blades, contacting the coolantsprayed underside of a chill substrate, for removing residual coolant therefrom, and in conjunction therewith to prevent migration of the removed liquid to the other side of the substrate by use of a pressure differential across the substrate.

An additional object of the invention is the use of a vacuum, applied to the underside of a moving chill substrate in a continuous casting process, to retain coolant sprayed against the underside substantially within a cooling apparatus for the substrate. Application of the vacuum in the vicinity of spraying nozzles and coolant scraping blades prevents migration of either the sprayed coolant or the coolant removed by the scraping blades to the other surface of the substrate.

In accordance with these and other objects, the present invention provides a cooling means for a moving chill member of a continuous casting apparatus for molten solidifying material. The chill member is more specifically a substrate with a pair of opposed surfaces, such as a moving belt, for example. The cooling means includes a pressurizing means for effecting a pressure gradient across the two surfaces of the substrate forming the chill member. Spraying means is provided for spraying a coolant against that surface of the substrate which is exposed to the lower pressure, thus preventing flow of the coolant from that surface to the other surface of the substrate.

The invention more specifically provides a cooling means for a moving chill member of a continuous casting apparatus, including a plurality of nozzles for spraying the coolant against one surface of the substrate. Scraping means is provided for removing residual coolant from the sprayed surface, and a substantially sealed enclosure provided for the nozzles and scraping means. An evacuating means is provided for evacuating the enclosure, thereby to provide a pressure gradient acting on the coolant to prevent its migration from the sprayed surface to the other surface of the substrate.

The enclosure is preferably sealed against the sprayed surface of the substrate by elongated seals formed of polytetrafluoroethylene, and the scraping means is preferably formed of a plurality of sheets of stainless steel, contacting the sprayed surface of the substrate and oriented against the direction of travel thereof. The coolant used is preferably water at a temperature above the dew point for the ambient conditions, and the pressure gradient provided for the two surfaces of the substrate is in the approximate range of 1.5 to 4 cm Hg.

BRIEF DESCRIPTION OF THE DRAWING

The foregoing and other objects, features and advantages of the invention will become more readily apparent upon reference to the following detailed description of the best mode for carrying out the invention, when taken in conjunction with the accompanying drawing, in which:

FIG. 5 shows a sectional view of the cooling apparatus according to the invention, taken along lines 5—5 of FIG. 4A; and FIG. 6 is a magnified view of a vacuum section forming a part of FIG. 5.

BEST MODE FOR CARRYING OUT THE INVENTION

The present invention may be utilized in any filament casting operation in which a puddle of molten, solidifying material is ejected from a nozzle of a container therefor onto a moving chill member. The invention is particularly applicable to casting apparatus for amorphous metal alloys, however, in which the puddle must be very rapidly quenched on a rapidly moving carrier.

It is known, for example, that a chill rate of approximately $10^5$ to $10^6$ °C./sec is required for casting amorphous metal alloys. Solidification of the puddle in a short time is thus assured, and is provided at a travel distance of the moving chill member which is easily calculated, once the travel rate of the member is known.

Figure 1:
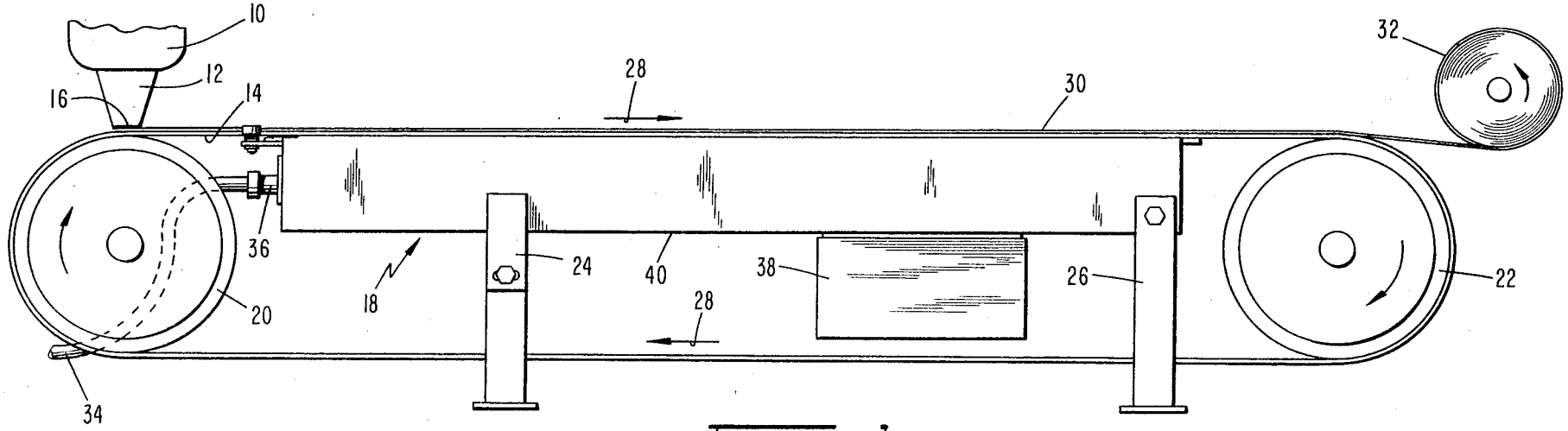
FIG. 1 shows an elevational or side view of a continuous belt casting apparatus incorporating a cooling apparatus in accordance with the present invention.

Referring now to FIG. 1, a continuous casting apparatus for such amorphous alloys is shown as containing a crucible 10 for the molten alloy. A nozzle 12 discharges the abovementioned puddle of alloy for solidification on a moving chill substrate or member. In the illustrative apparatus of FIG. 1, a moving belt 14 forms the substrate and receives the molten alloy 16, discharged from crucible 10 by nozzle 12.

In order to chill the molten alloy rapidly, from an initial temperature of approximately 1300° C. for example, a cooling apparatus 18 is shown in contact with the belt 14. It should be understood that a rapidly rotating chill wheel may be provided, instead of the illustrative belt 14, and that the principles of the present invention are equally applicable thereto.

The cooling apparatus 18 cools the underside of belt 14 which, in turn, chills and solidifies the molten alloy 16 carried on the upper surface of the belt. This arrangement is dictated, inter alia, by considerations of the quality of the filament resulting from the casting operation. The presence of any contaminants on the upper surface of the belt, hereinafter referred to as the casting surface thereof, leads to significant reductions in filament quality, particularly where thin film filaments are produced.

As previously described, the prior art provides for cooling the belt by spraying a coolant, such as water for example, against the surface of the chill member opposite to the casting surface, hereinafter referenced as the converse surface thereof. The present invention advantageously provides positive means for eliminating any migration of contaminants, particularly of coolant material, from the converse surface to the casting surface of the chill member, thereby improving the quality of the filament produced.

In FIG. 1, belt 14 is seen to form an endless loop around a pair of rollers 20 and 22. One of the rollers may be driven by a driving means, such as an electric motor (not shown). Cooling apparatus 18 is supported on a pair of stands 24, 26.

Figure 2:
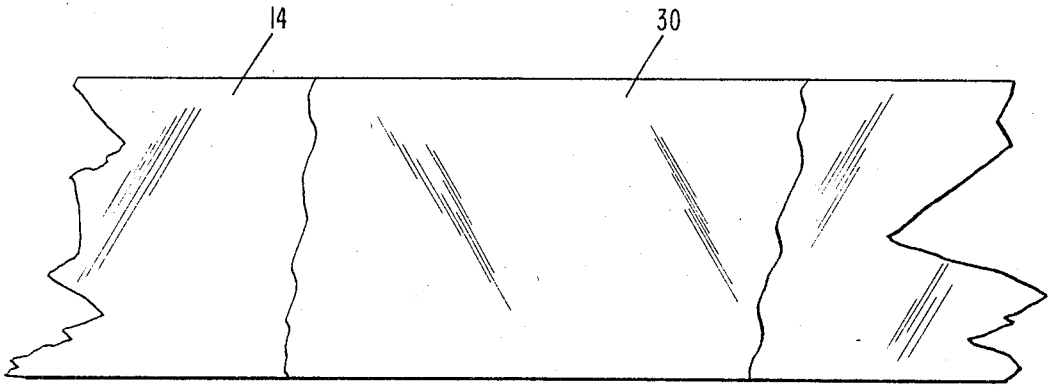
FIG. 2 shows the belt and solidified metal filament formed thereon (broken away for clarity) in the structure of FIG. 1.

As mentioned above, this apparatus is used to cool the belt which thus acts as the chill member for quenching the molten amorphous alloy. As the belt travels in the direction of arrows 28, the alloy solidifies in response to the cooling effect, to form a glassy metal filament 30 (FIGS. 1 and 2).

The filament is wound on a takeup reel 32 suitably driven to accept and wind the filament at an appropriate high rate determined by the speed of belt 14.

In the present invention, the coolant used to cool the belt 14 is water, through other fluids are similarly useful. The water is supplied to cooling apparatus 18 by a tubing 34 and coupling 36 (see FIG. 1). The used coolant, having been heated by the belt, is collected in a sump 38 for disposal.

Figure 3A:
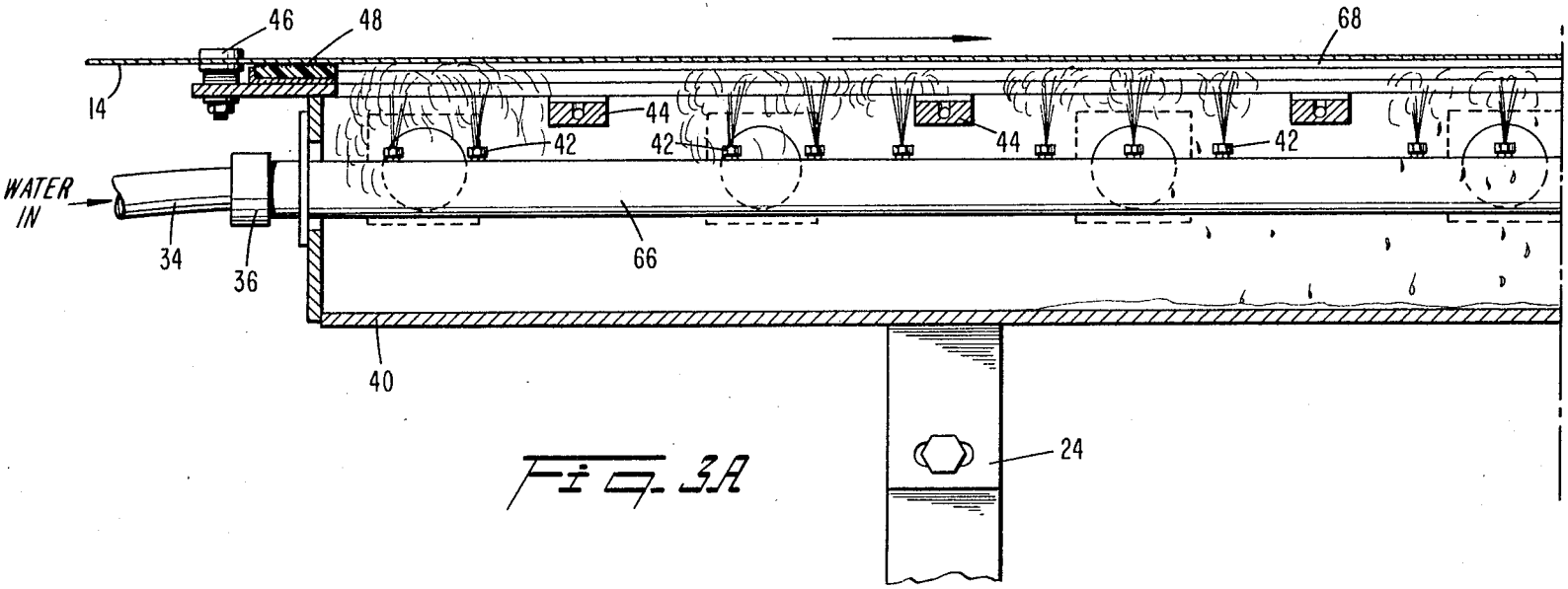
FIGS. 3A and 3B show a detailed elevational view, partially in section, of the cooling apparatus according to the invention.
Figure 3B:
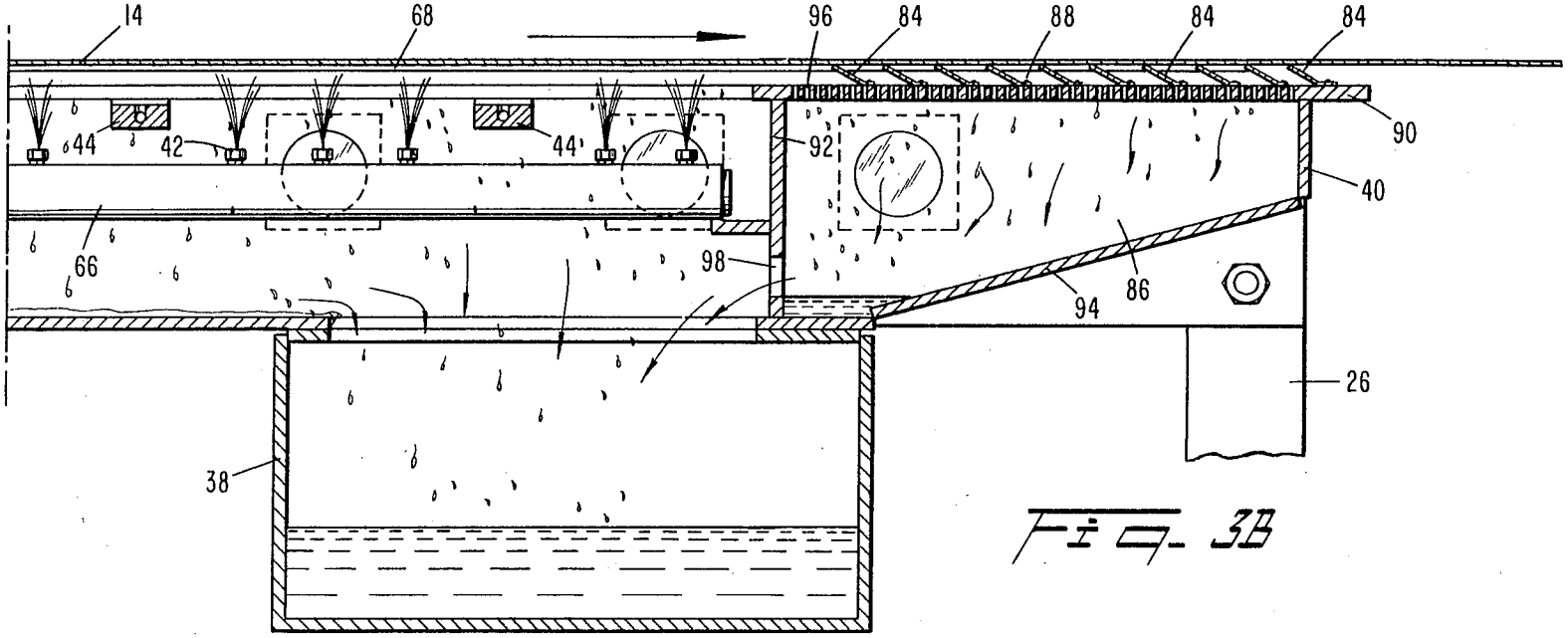

Referring now to FIGS. 3A and 3B, the cooling apparatus of the invention is illustrated in more detail including a box-like enclosure 40 forming a cooling chamber within which is provided a plurality of nozzles 42 for spraying the coolant against the converse surface of belt 14. Connected to coupling 36 is a manifold 66, shown in FIGS. 3A–3B, 4A–4B and 5, supplying the pressurized coolant to nozzles 42. An advantage of the structure of the present embodiment is the achievement of high heat transfer rates, as needed for rapid quenching of amorphous magnetic metal melts and generally available only by nucleate boiling of the coolant.

In order to achieve nucleate boiling in the cooling chamber, the belt should be at a temperature above the boiling point of the coolant. It is also desirable to permit the coolant, which is directly sprayed thereagainst, to fall freely from the surface against which it is impinged. Inasmuch as the belt temperature is over 100° C., at the cooling station above the boiling point of the water coolant, and all the requirements are met by the structure of FIGS. 3A–3B, the advantageous nucleate boiling of the coolant against the belt occurs as the belt progresses through the succession of high pressure sprays from the nozzles 42.

In order to insure the high quality of the filament produced by the casting apparatus of the invention, prevention of seepage, or migration, of the coolant or other contaminant from the converse surface to the casting surface of the belt is prevented. Such migration is positively stopped in accordance with the present invention by a pressure differential or gradient between the casting and converse surfaces. The pressure gradient is preferably provided by at least a partial evacuation of the cooling box or enclosure 40. Towards that end, evacuating port structures 44 are provided. These structures are shown in greater detail in FIGS. 5 and 6, to be discussed infra.

Figure 4A:
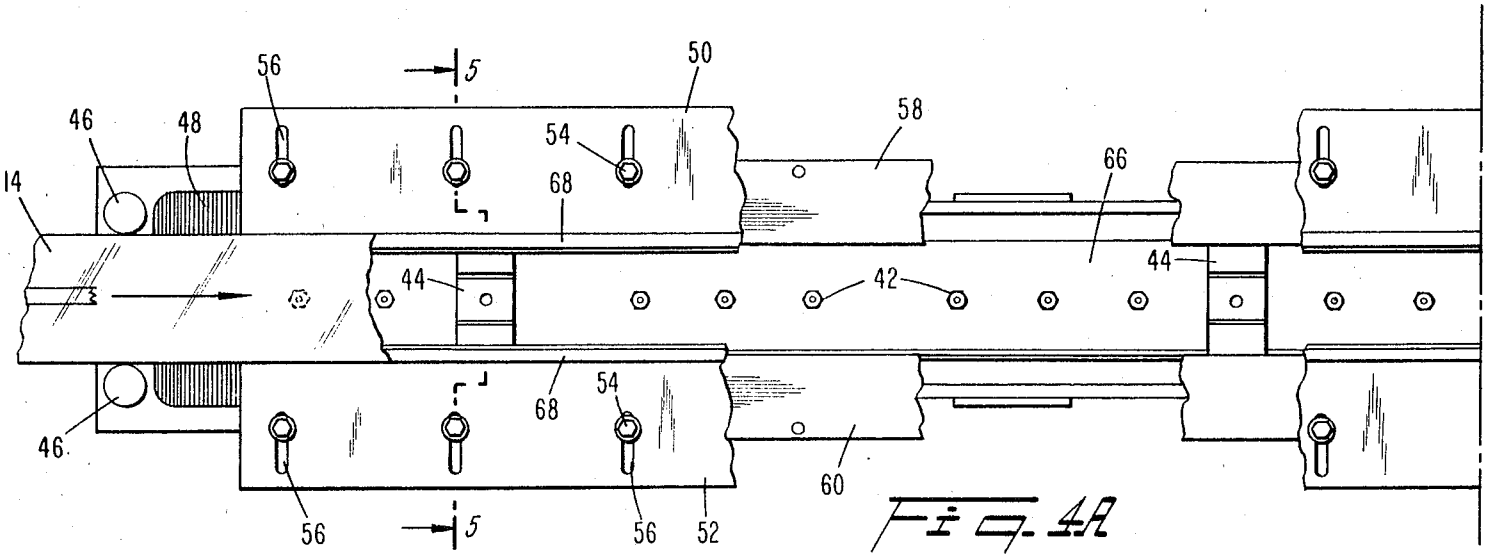
FIGS. 4A and 4B show a plan view, partially broken away, of the cooling apparatus according to the invention.

Referring first to FIGS. 3A and 4A, belt 14 is laterally guided by a pair of idler rollers 46 at the entrance to the cooling chamber. An inlet seal and bottom wiper 48 is provided to maintain the vacuum produced within the enclosure. This prevents the entry of boundary layer air from the belt 14 at the upstream end.

Adjustably disposed carrier and sealing plates 50 and 52 are provided at either side of belt 14, and thus form the top (except for belt 14) of the enclosure 40 throughout the length of the cooling apparatus. The plates 50, 52 are laterally adjustable by a plurality of adjusting bolts 54 passing through transverse adjustment notches 56 in the plates (see FIGS. 4A, 4B and 5). The bolts 54 are mounted on a pair of permanently secured collar plates 58 and 60 of enclosure 40. Adjusting bolts 54 specifically are held by nuts 62 below collar plates 58, 60.

The converse surface (bottom) of the belt is supported by elongated seals 68. The seals also acting as guides, are preferably mounted in grooves in adjustable guide plates 50 and 52. An appropriate material of which the seals may be formed is polytetrafluoroethylene (Teflon). The seals 68 possess a low coefficient of friction, thus permitting the belt to slide easily thereover, and effectively seal the top of enclosure 40. The top surface of the guides 68 are crowned to provide substantially line contact, thus increasing the pressure along the line for more efficient sealing action.

In operation, pressurized coolant is supplied by manifold 66 through nozzles 42 spraying against the converse surface of belt 14. The coolant undergoes nucleate boiling against the converse surface, and resulting vapor and droplets of coolant are formed, thus efficiently cooling the belt 14.

Application of a negative pressure by the evacuating port structures 44 assures that the belt 14 is held down against the seals 68 described above. Any slight openings existing along the seals as the belt 14 rapidly moves along do not result in leakage around the edges of the belt 14, since the immediate inflow of air (see flow arrows in FIGS. 5 and 6) exerts a sweeping force on the coolant forcing the same back into enclosure 40. This feature positively prevents transfer of coolant to the belt, pulleys and rollers.

It is, of course, appreciated that a similar result may be obtained by application of a positive or superatmospheric pressure to the casting surface, or by application of a combination of positive pressure to the casting surface and a negative pressure to the converse surface.

Any application of a pressure gradient across the opposing surfaces of a substrate forming a chill member such as belt 14, in which the casting surface is at a higher pressure than the converse surface, leads to the desired sweeping action. Such a pressure gradient sweeps coolant material back into the enclosure at any imperfections of the seals or at any point where the belt might vibrate momentarily lifting the edges from the seals 68. Thus, the concept provides not only a tightened seal for enclosure of the cooling apparatus, but a positive, sweeping action keeping the coolant isolated inside the cooling chamber. The falling droplets and condensed vapor are collected in enclosure 40 and flow to the sump 38, for appropriate collection and recirculation (see FIG. 3B).

Referring now specifically to FIGS. 5 and 6, belt 14 is shown in greater detail and in cross section and includes a body or substrate 70, preferably of a copper alloy, with casting and converse surfaces 72 and 74. Vacuum port structure 44 is connected to a source of negative pressure by a tubing 76, and forms an entry port 78 and connecting passageway 80. Application of a vacuum to passageway 78 causes evacuation of vapor from upper region 82 of the enclosure 40 adjacent the converse surface 74 of substrate 70. Additionally, atmospheric pressure induces passage of ambient air through imperfections in elongated seals 68 to enter the region, as shown by the arrows in the two Figures.

As is clear from the discussion above, the vapor shown in FIG. 6 is formed partially by nucleate boiling of the coolant sprayed by nozzle 42 against converse surface 74 of the substrate. A relatively low volume of coolant is used, but the coolant is sprayed at high pressures, preferaby 40–80 lbs/in., and thus at high velocity. This assures the maximum penetration of the fresh liquid through the liquid film against the converse side 74 of the belt. The latent heat of vaporization is utilized assuring optimization of the heat transfer process.

The vacuum provided by the port structures 44 advantageously holds the belt 14 down in position against the impact of the coolant spray.

Furthermore, relative small sized orifice nozzles are used to provide the increased spray jet velocity while maintaining the substantially constant rate of coolant flow.

Experimental results obtained during development of the invention indicate that an improved increase in heat transfer is observed in response to the increased velocity of the spray due to increased coolant pressure. Additional results show that simply increasing the volume of coolant flow, without a coordinated increase in pressure, provided no significant improvement in heat transfer characteristics. Accordingly, the use of relatively small nozzles 42, in conjunction with a more highly pressurized coolant, results in a more efficient cooling apparatus, thus requiring reduced heat transfer area to produce the desired quench rate.

A possible explanation of the increased heat transfer observed with increased nozzle spray velocity is the increased scrubbing action provided by the spray at the belt surface. Specifically, any vapor or steam produced during the cooling process is scrubbed away more efficiently by the higher velocity spray. Thus, any such film of steam or vapor, which interferes with heat transfer efficiency, is scrubbed from the belt and provides increased efficiency of operation.

Preferably, the sprayed coolant is above the dew point temperature at the time of spraying against surface 74. In fact, the coolant is preferably heated to a temperature of approximately 75° C., in order to assure that no condensation occurs on casting surface 72, thus further avoiding the addition of any contaminant to the casting surface.

As has been previously described herein, for casting amorphous alloys it is required to provide extremely rapid chill rates. It is thus found that the use of a "heated" coolant, e.g., water at temperatures about 75° C., promotes an improved belt surface condition for quench.

In accordance with another feature of the invention, multiple scrapers 84 are provided adjacent terminal vacuum chamber 86, for removing any residual coolant from the converse surface 74 prior to exiting of belt 14 from contact with the cooling apparatus. This mechanical removal of excess coolant and vapor film assisted by the vacuum in chamber 86 assures that coolant does not, through contact with rollers 20, 22 and the like, ultimately migrate to the casting surface 72 and detrimentally affect the quality of the produced filament. Without the scrapers 84, a liquid film tends to be trapped on the belt surface and the coolant layer sprayed thereon during the next pass in the cooling apparatus must penetrate this film. Such a trapped film thus reduces the effective heat transfer rate of the cooling apparatus by reducing the efficiency of nucleate boiling.

Figure 4B:
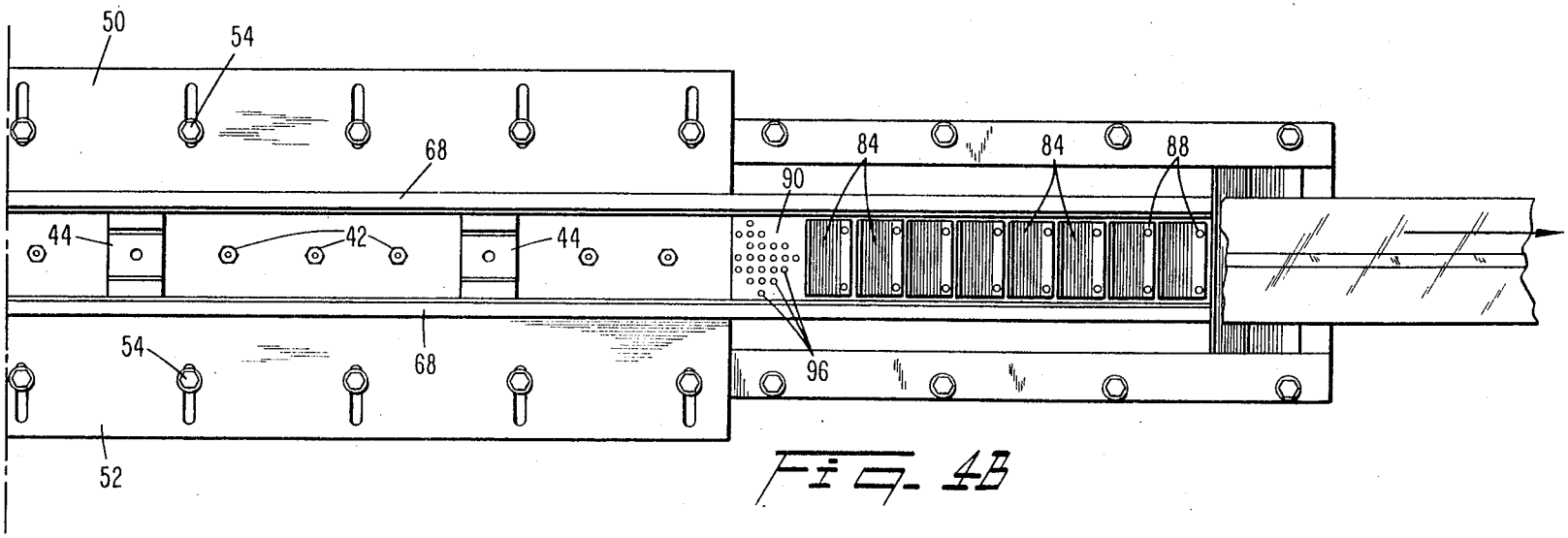

As seen in FIGS. 3B and 4B, scrapers 84, preferably formed of thin sheets of stainless steel, are fastened by means of fasteners 88 to a perforate plate 90. Scrapers 84 are preferably oriented oppositely to the direction of travel of belt 14, to provide a more aggressive removal of the remanent coolant and film. The angle formed between scrapers 84 and belt 14 may be fairly sharp, to assure removal of a maximal amount of remanent coolant. A preferred angle is approximately 20°.

As further seen in FIG. 3B, chamber 86 includes a supporting wall 92 for perforate plate 90 and an inclined bottom surface 94. Any coolant removed from the converse surface of belt 14 by scrapers 84 is seen to flow downwardly through perforations 96 onto bottom surface 94 for discharge, through an opening 98 in supporting wall 92, to sump 38.

As mentioned above, in order to prevent spreading of the coolant by scrapers 84 around the edges of the belt and up onto the casting surface thereof, chamber 86 is advantageously kept at a reduced pressure. Accordingly, counterflowing air, urged by the pressure differential between the casting and converse surfaces, forces the coolant back towards chamber 86 rather than towards the casting surface of belt 14. Separate evacuating structures may be provided for chamber 86 to achieve the above-described result. In the preferred embodiment, it is contemplated that the evacuating port structures 44 providing the reduced pressure of the entire spraying chamber, similarly provide the reduced pressure for chamber 86. The reduced pressure is communicated to chamber 86 by opening 98 in wall 92.

The foregoing description thus describes an apparatus for efficient usage of coolant in a continuous casting environment, and with dry casting surfaces providing an improvement in the quality of produced filament. These results are attained by at least partially evacuating the chamber in which the spray cooling is conducted, by scraping and removing any remanent coolant from the converse surface of the chill substrate, and by pressurizing and heating the coolant and spraying the same through a reduced nozzle orifice.

A pressure differential of approximately 2.5 cm. Hg. is desirable between the casting surface and the converse surface of the belt, although other values of the differential are also beneficial. Additionally, while scrapers oriented against the direction of motion of the belt are preferred, at an inclination of 20°, it is appreciated that other orientations are similarly acceptable within the broad concepts of the invention.

The preceding specification describes, by way of illustration and not of limitation, a preferred embodiment of the invention. It is appreciated that equivalent variations of the invention will occur to those skilled in the art. An example of one possible variation of the invention is the use of air jets located around the edges of the belt to force back any coolant, rather than evacuating the undersurface of the belt. Such a structure nonetheless provides a pressure gradient, or differential, forcing the coolant back towards the converse surface. Such modifications, variations and equivalents are within the scope of the invention as recited with greater particularity in the appended claims, when interpreted to obtain the benefits of all equivalents to which the invention is fairly and legally entitled.

We claim:

1. A cooling process for continuous casting of molten solidifying material on a moving chill member having a casting surface for receiving said material and a converse surface, comprising the steps of:

providing a pressure gradient across said member for causing the pressure at said casting surface to exceed the pressure at said converse surface;

spraying a coolant against said converse surface following receipt of said material on said casting surface; and scraping remanent coolant from said converse surface prior to said casting surface receiving said material;

whereby flow of said coolant from said converse surface to said casting surface is prevented and a chill rate sufficient for casting amorphous metal alloys is provided.

2. The cooling process for continuous casting of claim 1, further comprising the step of pressurizing said coolant prior to said spraying step, whereby said coolant is sprayed at a relatively high velocity.

3. The cooling process for continuous casting of claim 1, further comprising the step of sealing the edges of said member to maintain said pressure gradient.

4. The cooling process for continuous casting of claim 1, wherein the step of providing a pressure gradient includes the step of evacuating an enclosed chamber adjacent said converse surface.

5. The cooling process for continuous casting of claim 1, wherein said chill rate is substantially $10^5$ to $10^6$ °C./sec.

6. The cooling process for continuous casting of claim 1, wherein said converse surface is substantially free of coolant when said casting surface receives said material.

7. In an apparatus for continuous casting of a molten solidifying material on a moving chill member, the chill member including a casting surface for receiving material at a particular point thereon and a converse surface, the improvement comprising cooling means for cooling said chill member including:

pressurizing means for effecting a pressure gradient across said member wherein the pressure at said casting surface exceeds the pressure at said converse surface, and spraying means for spraying a coolant pressurized above atmospheric pressure against said converse surface only downstream on said chill member from the point of receipt of said material on said casting surface, the coolant pressurization serving to increase scrubbing action provided by the spray at said converse surface of the chill member, thereby optimizing heat transfer efficiency, said pressurizing means thereby preventing migration of said coolant from said converse surface to said casting surface.

8. The apparatus for continuous casting of claim 7, wherein said cooling means comprises sealing means for containing the coolant from said spraying means in a volume bounded at the edges of said converse surface and exposed to said pressure gradient, thereby preventing said sprayed coolant from migrating to said casting surface.

9. The apparatus for continuous casting of claim 8, wherein said pressurizing means comprises vacuum generating means for applying negative pressure to said converse surface.

10. The apparatus for continuous casting of claim 7, further comprising scraping means for removing said coolant from said converse surface.

11. The apparatus for continuous casting of claim 10, wherein said scraping means is contained within a volume bounded by a portion of said converse surface exposed to said pressure gradient, thereby preventing coolant removed by said scraping means from migrating from said converse surface to said casting surface.

12. A cooling means for a continuous casting apparatus having a moving chill member having a casting surface for receiving molten solidifying material at a particular point thereon and a converse surface comprising:

(a) supplying means for supplying coolant above atmospheric pressure;

(b) spraying means for spraying a coolant against said converse surface only downstream on said chill member from the point of receipt of said material on said casting surface;

(c) scraping means for removing remanent coolant material from said converse surface upstream from the point of receipt of said material on said casting surface;

(d) an enclosure in sealing contact with one surface of said moving chill member; and (e) pressurizing means for applying a pressure gradient across said enclosure for preventing migration of coolant from said converse surface to said casting surface;

whereby the coolant pressurization serves to increase scrubbing action provided by the spray at said converse surface of the chill member so as to optimize heat transfer efficiency.

13. The cooling means recited in claim 12, wherein said pressurizing means provided a negative pressure to said enclosure and includes a plurality of vacuum port structures mounted on said enclosure at spaced locations along said member and adjacent said one surface.

14. The cooling means recited in claim 12, wherein said coolant comprises water at a temperature above the dew point for the ambient environmental conditions in the vicinity of said cooling means.

15. The cooling means recited in claim 12, further comprising low friction sealing means between said enclosure and said one surface of said moving chill member, said sealing means including elongated plastic rods mounted on said enclosure and extending along the edges of said one surface.

16. The cooling means of claim 15, wherein said rods are formed of polytetrafluoroethylene, the operative surface of said rods being crowned for sealing said enclosure to said surface edges of said chill member.

17. The cooling means recited in claim 12, wherein said pressurizing means comprises means producing a pressure gradient in the range of 1.5 to 4 cm Hg.

18. The cooling means recited in claim 17, wherein the pressure gradient produced is 2.5 cm Hg.

19. The cooling means recited in claim 12, wherein said spraying means comprises a series of nozzles for spraying a coolant fluid against said converse surface.

20. The cooling means recited in claim 19, wherein said nozzles are located within said enclosure and are directed upwardly, and said pressurizing means provides a negative pressure to said enclosure.

21. The cooling means recited in claim 20, wherein said scraping means is located within said enclosure.

22. The cooling means recited in claim 21, wherein said scraping means comprises at least one sheet of thin, relatively rigid material oriented against the direction of motion of said moving chill member.

23. The cooling means recited in claim 22, wherein said scraping means is formed of at least one sheet of stainless steel, angled at approximately 20° with respect to said converse surface.

24. The cooling means recited in claim 16 wherein said supplying means includes a manifold extending along said member and said spraying means includes a plurality of nozzles on said manifold directed towards said converse surface, thereby providing a plurality of spray jets to cool said member.

* * * * *